US007935243B2

(12) United States Patent
Chabot et al.

(10) Patent No.: US 7,935,243 B2
(45) **Date of Patent: *May 3, 2011**

(54) SYSTEMS AND METHODS FOR PRODUCING A CRUDE PRODUCT

(75) Inventors: Julie Chabot, Novato, CA (US); Bo Kou, Albany, CA (US); Vivion Andrew Brennan, San Francisco, CA (US); Erin Maris, Alameda, CA (US); Shuwu Yang, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 399 days.

This patent is subject to a terminal disclaimer.

(21) Appl. No.: 12/233,393

(22) Filed: Sep. 18, 2008

(65) Prior Publication Data

US 2010/0065474 A1 Mar. 18, 2010

(51) Int. Cl.
*C10G 45/00* (2006.01)

(52) U.S. Cl. ..... 208/59; 208/57; 208/58

(58) Field of Classification Search ..... 208/57–59, 208/107–108, 112

See application file for complete search history.

(56) References Cited

U.S. PATENT DOCUMENTS 3,817,856 A 6/1974 Aaron et al.
4,485,004 A 11/1984 Fisher et al.
4,591,426 A 5/1986 Krasuk et al.
4,592,827 A 6/1986 Galiasso et al.
4,612,109 A 9/1986 Dillon et al.
4,684,456 A 8/1987 Van Driesen et al.
4,710,486 A 12/1987 Lopez et al.
4,824,821 A 4/1989 Lopez et al.
4,943,547 A 7/1990 Seamans et al.
4,970,190 A 11/1990 Lopez et al.
5,039,392 A 8/1991 Bearden et al.
5,041,404 A 8/1991 Seamans et al.
5,162,282 A 11/1992 Lopez et al.
5,164,075 A 11/1992 Lopez et al.
5,178,749 A 1/1993 Lopez et al.
5,298,152 A 3/1994 Kramer et al.
5,371,308 A 12/1994 Gosselink et al.
5,374,348 A 12/1994 Sears et al.
5,484,755 A 1/1996 Lopez et al.
5,527,473 A 6/1996 Ackerman
5,871,638 A 2/1999 Pradhan et al.
5,914,010 A 6/1999 Hood et al.

(Continued)

OTHER PUBLICATIONS

Hydrodesulfurization Catalysis by Transition Metal Sulfides by Pecoraro et al., Journal of Catalysis 67, 430-445 (1981).

(Continued)

*Primary Examiner* — Robert J Hill, Jr.
*Assistant Examiner* — Brian McCaig

(57) ABSTRACT

Systems and methods for hydroprocessing a heavy oil feedstock with reduced heavy oil deposits, the system employs a plurality of contacting zones and separation zones zone under hydrocracking conditions to convert at least a portion of the heavy oil feedstock to lower boiling hydrocarbons, forming upgraded products, wherein the first contacting zone is operated at a temperature of at least 10° F. lower than a next contacting zone. The contacting zones operate under hydrocracking conditions, employing a slurry catalyst for upgrading the heavy oil feedstock, forming upgraded products of lower boiling hydrocarbons. In the separation zones, upgraded products are removed overhead and, optionally, further treated in an in-line hydrotreater. At least a portion of the non-volatile fractions recovered from at least one of the separation zones is recycled back to the first contacting zone in the system.

32 Claims, 4 Drawing Sheets

U.S. PATENT DOCUMENTS 5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.
6,190,542 B1 2/2001 Comolli et al.
6,241,874 B1 6/2001 Wallace et al.
6,270,654 B1 8/2001 Colyar et al.
6,274,530 B1 8/2001 Cayton et al.
6,277,895 B1 8/2001 Zhou et al.
6,278,034 B1 8/2001 Espinoza et al.
6,291,391 B1 9/2001 MacArthur et al.
6,299,760 B1 10/2001 Soled et al.
6,451,729 B1 9/2002 Song et al.
6,454,932 B1 9/2002 Baldassari et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori et al.
2004/0163999 A1 8/2004 Plantega et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott et al.
2006/0207917 A1 9/2006 Domokos et al.
2006/0231465 A1 10/2006 Bhan et al.
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0138058 A1* 6/2007 Farshid et al. ..... 208/57
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.

OTHER PUBLICATIONS

A review of zinc dialkyldithiophosphates (ZDDPS): characterization and role in the lubricating oil by Barnes et al., Tribology International 34 (2001) 389-395.

Petroleum residue upgrading with dispersed catalysts Part I. Catalysts activity and selectivity. Applied Catalysis A: General 204 (2000) 203-213.

Iron sulfide Catalysts for Coal Liquefaction Prepared Using a Micellar Technique by Chadha et al., Ind. Eng. Chem. Res. 1996. 35. 2916-2919.

Nickel, Cadium and Lead Sulfides as Catalysts in the Vapor Phase Reduction of Nitrobenzene by Brown et al., Laboratory of Physical Chemistry Indiana University, Jul. 29, 1938.

Solution Synthesis of the unsupported Ni-W sulfide hytrotreating catalysts by Le et al., Catalysis Today 130 (2008) 24-31.

Thermal decomposition of sulfur comppunds. I. 2-Methyl-2-propanethiol by Thompson et al., Bureau of Mines. Petroleum and Oil-Shale Experiment Station. Nov. 19, 1951.

Hydroprocessing of heavy petroleum feeds: tutorial by Ancheyta et al. Catalysis today 109 (2005) 3-15.

A review of recent advances on process technologies for upgrading of heavy oils and residue by Rana et al., Fuel 86 (2007) 1216-1231.

Pending U.S. Appl. No. 12/506,840, filed Jul. 21, 2009.

Pending U.S. Appl. No. 12/506,885, filed Jul. 21, 2009.

Pending U.S. Appl. No. 12/506,987, filed Jul. 21, 2009.

Pending U.S. Appl. No. 12/506,937, filed Jul. 21, 2009.

Pending U.S. Appl. No. 12/212,737, filed Sep. 18, 2008.

Pending U.S. Appl. No. 12/233,171, filed Jul. 21, 2009.

Pending U.S. Appl. No. 12/233,393, filed Jul. 21, 2009.

Pending U.S. Appl. No. 12/233,439, filed Jul. 21, 2009.

Pending U.S. Appl. No. 12/212,796, filed Sep. 18, 2008.

Pending U.S. Appl. No. 12/233,327, filed Sep. 18, 2008.

* cited by examiner

SYSTEMS AND METHODS FOR PRODUCING A CRUDE PRODUCT

CROSS-REFERENCE TO RELATED APPLICATIONS

NONE.

TECHNICAL FIELD

The invention relates to systems and methods for treating or upgrading heavy oil feeds, and crude products produced using such systems and methods.

BACKGROUND

The petroleum industry is increasingly turning to heavy oil feeds such as heavy crudes, resids, coals, tar sands, etc. as sources for feedstocks. These feedstocks are characterized by high concentrations of asphaltenes rich residues, and low API gravities, with some being as low as less than 0°.

PCT Patent Publication No. WO2008/014947, US Patent Publication No. 2008/0083650, US Patent Publication No. 2005/0241993, US Patent Publication No. 2007/0138057, and U.S. Pat. No. 6,660,157 describe processes, systems, and catalysts for processing heavy oil feeds. Heavy oil feedstock typically contains large levels of heavy metals. Some of the heavy metals such as nickel and vanadium tend to react quickly, leading to deposition or trapping of vanadium-rich solids in equipment such as reactors. The solid deposition reduces available volume for reaction, cutting down on run time.

There is still a need for improved systems and methods to upgrade/treat process heavy oil feeds with reduced build-ups of heavy metals in the process equipment.

SUMMARY OF THE INVENTION

In one aspect, this invention relates to a process for by which a heavy oil feedstock can be upgraded with reduced heavy metal deposits in the front-end contacting zones. The process employ a plurality of contacting zones and separation zones, the process comprising: a) combining a hydrogen containing gas feed, a heavy oil feedstock, and a slurry catalyst in a first contacting zone under hydrocracking conditions to convert at least a portion of the heavy oil feedstock to upgraded products; b) sending a mixture of the upgraded products, the slurry catalyst, the hydrogen containing gas, and unconverted heavy oil feedstock to a separation zone; c) in the separation zone, removing the upgraded products with the hydrogen containing gas as an overhead stream, and removing the slurry catalyst and the unconverted heavy oil feedstock as a non-volatile stream; d) sending the non-volatile stream to another contacting zone under hydrocracking conditions with additional hydrogen gas, unconverted heavy oil feedstock, and optionally, a fresh slurry catalyst to convert the unconverted heavy oil feedstock to upgraded products; f) sending the upgraded products, the slurry catalyst, hydrogen, and unconverted heavy oil feedstock to a separation zone, whereby the upgraded products are removed with hydrogen as an overhead stream and the slurry catalyst and the unconverted heavy oil feedstock are removed as a non-volatile stream; and and wherein the first contacting zone operates at a temperature of at least at least 10° F. lower than the next contacting zone in series.

In another aspect, there is provided a method for upgrading a heavy oil feedstock employing a plurality of contacting zones and separation zones in which water and/or steam is mixed with the heavy oil feedstock and preheated prior to feeding to the first contacting zone.

In yet another aspect, the invention relates to a method for upgrading a heavy oil feedstock employing a plurality of contacting zones and separation zones, in which water and/or steam is injected into the first contacting zone, and wherein at least a portion of the non-volatile stream from a separation zone other than the first separation zone is recycled to the first contacting zone, wherein the recycled stream ranges between 3 to 50 wt. % of the total heavy oil feedstock to the process.

DETAILED DESCRIPTION

Figure 1:
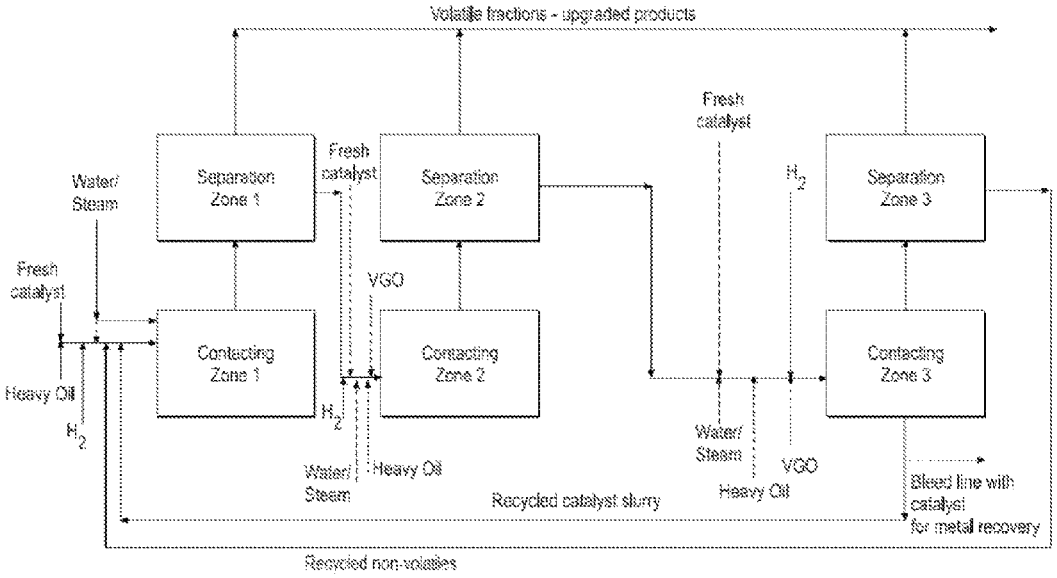
FIG. 1 is a block diagram that schematically illustrates an embodiment of a hydroprocessing system for upgrading a heaving oil feedstock, with a plurality of contacting zones and separation zones, wherein water and/or steam is injected into the front end contacting zone.

The present invention relates to an improved system to treat or upgrade heavy oil feeds, particularly heavy oil feedstock having high levels of heavy metals.

The following terms will be used throughout the specification and will have the following meanings unless otherwise indicated.

As used herein, "heavy oil" feed or feedstock refers to heavy and ultra-heavy crudes, including but not limited to resids, coals, bitumen, tar sands, etc. Heavy oil feedstock may be liquid, semi-solid, and/or solid. Examples of heavy oil feedstock that might be upgraded as described herein include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include bottom of the barrel and residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch" and "vacuum residue"—which have a boiling point of 524° C. (975° F.) or greater.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.00001 grams of alkali metal salts of one or more organic acids; and at least 0.005 grams of sulfur. In one embodiment, the heavy oil feedstock has a sulfur content of at least 5 wt. % and an API gravity of from −5 to +5.

In one embodiment, the heavy oil feedstock comprises Athabasca bitumen (Canada) having at least 50% by volume vacuum reside. In another embodiment, the feedstock is a Boscan (Venezuela) feed with at least 64% by volume vacuum residue. In one embodiment, the heavy oil feedstock contains at least 1000 ppm V. In another embodiment, the V level ranges between 5000 and 10000 ppm. In a third embodiment, at least 5000 ppm.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing." Hydroprocessing is meant any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

As used herein, hydrogen refers to hydrogen, and/or a compound or compounds that when in the presence of a heavy oil feed and a catalyst react to provide hydrogen.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

As used herein, the term "catalyst precursor" refers to a compound containing one or more catalytically active metals, from which compound a catalyst is eventually formed. It should be noted that a catalyst precursor may be catalytically active as a hydroprocessing catalyst. As used herein, "catalyst precursor" may be referred herein as "catalyst" when used in the context of a catalyst feed.

As used herein, the term "used catalyst" refers to a catalyst that has been used in at least a reactor in a hydroprocessing operation and whose activity has thereby been diminished. For example, if a reaction rate constant of a fresh catalyst at a specific temperature is assumed to be 100%, the reaction rate constant for a used catalyst is 95% or less in one embodiment, 80% or less in another embodiment, and 70% or less in a third embodiment. The term "used catalyst" may be used interchangeably with "recycled catalyst," "used slurry catalyst" or "recycled slurry catalyst."

As used herein, the term "fresh catalyst" refers to a catalyst or a catalyst precursor that has not been used in a reactor in a hydroprocessing operation. The term fresh catalyst herein also includes "re-generated" or "rehabilitated" catalysts, i.e., catalyst that has been used in at least a reactor in a hydroprocessing operation ("used catalyst") but its catalytic activity has been restored or at least increased to a level well above the used catalytic activity level. The term "fresh catalyst" may be used interchangeably with "fresh slurry catalyst."

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (particulates or crystallites) having very small average dimensions are dispersed within.

In one embodiment, the slurry catalyst stream contains a fresh catalyst. In another embodiment, the slurry catalyst stream contains a mixture of at least a fresh catalyst and a recycled (used) catalyst. In a third embodiment, the slurry catalyst stream comprises a used catalyst. In another embodiment, the slurry catalyst contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

As used herein, the "catalyst feed" includes any catalyst suitable for upgrading heavy oil feed stocks, e.g., one or more bulk catalysts and/or one or more catalysts on a support. The catalyst feed may include at least a fresh catalyst, a used catalyst only, or mixtures of at least a fresh catalyst and a used catalyst. In one embodiment, the catalyst feed is in the form of a slurry catalyst.

As used herein, the term "bulk catalyst" may be used interchangeably with "unsupported catalyst," meaning that the catalyst composition is NOT of the conventional catalyst form which has, i.e., having a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

As used herein, the term "contacting zone" refers to an equipment in which the heavy oil feed is treated or upgraded by contact with a slurry catalyst feed in the presence of hydrogen. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

In one embodiment, the upgrade process comprises a plurality of reactors for contacting zones, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing removed over 70% of the sulfur, over 90% of nitrogen, and over 90% of the heteroatoms in the crude product being processed.

In one embodiment, the contacting zone comprises a plurality of reactors in series, providing a total residence time ranging from 0.1 to 15 hours. In a second embodiment, the resident time ranges from 0.5 to 5 hrs. In a third embodiment, the total residence time in the contacting zone ranges from 0.2 to 2 hours.

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction. In one embodiment, the non-volatile fraction stream comprises unconverted heavy oil feed, a small amount of heavier hydrocracked liquid products (synthetic or less-volatile/non-volatile upgraded products), the slurry catalyst and any entrained solids (asphaltenes, coke, etc.).

Depending on the conditions and location of the separation zone, in one embodiment, the amount of heavier hydrocracked products in the non-volatile fraction stream is less than 50 wt. % (of the total weight of the non-volatile stream). In a second embodiment, the amount of heavier hydrocracked products in the non-volatile stream from the separation zone is less than 25 wt. %. In a third embodiment, the amount of heavier hydrocracked products in the non-volatile stream from the separation zone is less than 15 wt. %. It should be noted that at least a portion of the slurry catalyst remains with the upgraded feedstock as the upgraded materials is withdrawn from the contacting zone and fed into the separation zone, and the slurry catalyst continues to be available in the separation zone and exits the separation zone with the non-volatile liquid fraction.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fractions exit the side or bottom of the equipment with the slurry catalyst and entrained solid fraction, if any.

As used herein, the term "bleed stream" or "bleed off stream" refers to a stream containing used (or recycled) catalyst, being "bled" or diverted from the hydroprocessing system, helping to prevent or "flush" accumulating metallic sulfides and other unwanted impurities from the upgrade system.

In one embodiment, the bleed off stream comprises non-volatile materials from a separation zone in the system, typically the last separation zone, containing comprising unconverted materials, heavier hydrocracked liquid products (synthetic products or non-volatile/less-volatile upgraded products), slurry catalyst, small amounts of coke, asphaltenes, etc. In another embodiment, the bleed off stream is the bottom stream from an interstage solvent deasphalting unit in the system. The bleed stream ranges from any of 0.30 to 25 wt. %; 1-30 wt. %; or 0.5 to 15 wt. % of the heavy oil feed stock.

In one embodiment, the upgrade system comprises at least two upflow reactors in series with at least two separators, with each separator being positioned right after each reactor and with the interstage SDA unit being positioned before at least one reactor in the system. In another embodiment, the upgrade system comprises at least two upflow reactors and at least two separators in series, with of each of the separators being positioned right after each reactor, and the interstage SDA unit being position after the 1$^{st}$ separator in the series. In a fourth embodiment, the upgrade system may comprise a combination of separate reactors and separate separators in series with multi-stage reactor-separators, with the SDA being positioned as an interstage treatment system between any two reactors in series.

Process Conditions: In one embodiment, an interstage SDA unit is employed in an upgrade process having a plurality of contacting zones, with the process condition being controlled to be more or less uniformly across the contacting zones. In another embodiment, the condition varies between the contacting zones for upgrade products with specific properties.

In one embodiment, the process conditions are maintained under hydrocracking conditions, i.e., at a minimum temperature to effect hydrocracking of a heavy oil feedstock. In one embodiment, at a temperature of 410° C. to 600° C., at a pressure ranging from 10 MPa to 25 MPa.

In one embodiment, the contacting zone process temperature ranges from about 410° C. (770° F.) to about 600° C. (1112° F.) in one embodiment, less than about 462° C. (900° F.) in another embodiment, more than about 425° C. (797° F.) in another embodiment. In one embodiment, the temperature difference between the inlet and outlet of a contacting zone ranges from 5 to 50° F. In a second embodiment, from 10 to 40° F.

In one embodiment, the temperature of the separation zone is maintained within ±90° F. (about ±50° C.) of the contacting zone temperature in one embodiment, within ±70° F. (about ±38.9° C.) in a second embodiment, and within ±15° F. (about ±8.3° C.) in a third embodiment, and within ±5° F. (about ±2.8° C.). In one embodiment, the temperature difference between the last separation zone and the immediately preceding contacting zone is within ±50° F. (about ±28° C.).

In one embodiment, the pressure of the separation zone is maintained within ±10 to ±50 psi of the preceding contacting zone in one embodiment, and within ±2 to ±10 psi in a second embodiment.

In one embodiment, the process pressure may range from about 5 MPa (1,450 psi) to about 25 MPa (3,625 psi), about 15 MPa (2,175 psi) to about 20 MPa (2,900 psi), less than 22 MPa (3,190 psi), or more than 14 MPa (2,030 psi).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h^{-1}$ to about 5 $h^{-1}$, about 0.75 $h^{-1}$ to about 1.5 $h^{-1}$, or about 0.2 $h^{-1}$ to about $10^{-1}$. In some embodiments, LHSV is at least 0.5 $h^{-1}$, at least 1 $h^{-1}$, at least 1.5 $h^{-1}$, or at least $2^{-1}$. In some embodiments, the LHSV ranges from 0.025 to 0.9 $h^{-1}$. In another embodiment, the LHSV ranges from 0.1 to 3 LHSV. In another embodiment, the LHSV is less than 0.5 $h^{-1}$.

In one embodiment wherein all of the non-volatile fractions stream from at least a separation zone is sent to the SDA unit for deasphalting, the solid deposit in the last contacting zone in the system decreases by at least 10% (in terms of deposit volume) after a similar run time compared to a prior art operation without deasphalting with the SDA unit. In a second embodiment, the solid deposit decreases by at least 20% compared to an operation without the use of the interstage SDA unit. In a third embodiment, the solid deposit decreases at least 30%.

Heavy Oil Feed: The unconverted heavy oil feed here herein may comprise one or more different heavy oil feeds from different sources as a single feed stream, or as separate heavy oil feed streams. In some embodiments of the present invention, at least a portion of the heavy oil feed (to be upgraded) is "split" or diverted to at least one other contacting zones in the system (other than the first contacting zone), or to the interstage SDA unit prior to being fed into a contacting zone.

In one embodiment, "at least a portion" means at least 5% of the heavy oil feed to be upgraded. In another embodiment, at least 10%. In a third embodiment, at least 20%. In a fourth embodiment, at least 30% of the heavy oil feed is diverted to at least a contacting zone other than the first one in the system. In one embodiment, the heavy oil feedstock is preheated prior to being blended with the slurry catalyst feed stream(s). In another embodiment, the blend of heavy oil feedstock and slurry catalyst feed is preheated to create a feedstock that is sufficiently of low viscosity to allow good mixing of the catalyst into the feedstock. In one embodiment, the preheating is conducted at a temperature that is at least about 100° C. (180° F.) less than the hydrocracking temperature within the contacting zone. In another embodiment, the preheating is at a temperature that is about at least 50° C. less than the hydrocracking temperature within the contacting zone.

Additional Hydrocarbon Feed: In one embodiment, additional hydrocarbon oil feed, e.g., VGO (vacuum gas oil), naphtha, MCO (medium cycle oil), solvent donor, or other aromatic solvents, etc. in an amount ranging from 2 to 40 wt. % of the heavy oil feed can be optionally added as part of the heavy oil feed stream to any of the contacting zones in the system. In one embodiment, the additional hydrocarbon feed functions as a diluent to lower the viscosity of the heavy oil feed.

Hydrogen Feed: In one embodiment, a hydrogen source is provided to the process. The hydrogen can also be added to the heavy oil feed prior to entering the preheater, or after the preheater. In one embodiment, the hydrogen feed enters the contacting zone co-currently with the heavy oil feed in the same conduit. In another embodiment, the hydrogen source may be added to the contacting zone in a direction that is counter to the flow of the crude feed. In a third embodiment, the hydrogen enters the contacting zone via a gas conduit separately from the combined heavy oil and slurry catalyst feed stream. In a fourth embodiment, the hydrogen feed is introduced directly to the combined catalyst and heavy oil feedstock prior to being introduced into the contacting zone. In yet another embodiment, the hydrogen gas and the combined heavy oil and catalyst feed are introduced at the bottom of the reactor as separate streams. In yet another embodiment, hydrogen gas can be fed to several sections of the contacting zone.

In one embodiment, the hydrogen source is provided to the process at a rate (based on ratio of the gaseous hydrogen source to the crude feed) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (11.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl). In one embodiment, some of the hydrogen (25-75%) is supplied to the first contacting zone, and the rest is added as supplemental hydrogen to other contacting zones in system.

In one embodiment, the upgrade system produces a volume yield of least 110% (compared to the heavy oil input) in upgraded products as added hydrogen expands the heavy oil total volume. The upgraded products, i.e., lower boiling hydrocarbons, in one embodiment include liquefied petroleum gas (LPG), gasoline, diesel, vacuum gas oil (VGO), and jet and fuel oils. In a second embodiment, the upgrade system provides a volume yield of at least 115% in the form of LPG, naphtha, jet & fuel oils, and VGO.

In one embodiment of the upgrade system, at least 98 wt % of heavy oil feed is converted to lighter products. In a second embodiment, at least 98.5% of heavy oil feed is converted to lighter products. In a third embodiment, the conversion rate is at least 99%. In a fourth embodiment, the conversion rate is at least 95%. In a fifth embodiment, the conversion rate is at least 80%. As used herein, conversion rate refers to the conversion of heavy oil feedstock to less than 1000° F. (538° C.) boiling point materials.

The hydrogen source, in some embodiments, is combined with carrier gas(es) and recirculated through the contacting zone. Carrier gas may be, for example, nitrogen, helium, and/or argon. The carrier gas may facilitate flow of the crude feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

Catalyst Feed: In some embodiments of the present invention, at least a portion of the fresh catalyst is "split" or diverted to at least one other contacting zones in the system (other than the first contacting zone). In one embodiment, "at least a portion" means at least 10% of the fresh catalyst. In another embodiment, at least 20%. In a third embodiment, at least 40%. In a fourth embodiment, at least 60% of the fresh catalyst is diverted to at least a contacting zone other than the first one in the system. In a fifth embodiment, all of the fresh catalyst is diverted to a contacting zone or than the $1^{st}$ contacting zone. In one embodiment, at least a portion of the fresh catalyst feed is sent to the contacting zone immediately following the interstage SDA unit. In another embodiment, all of the fresh catalyst is sent to contacting zone(s) other than the $1^{st}$ one in the system, with the first contacting zone only getting SDA bottoms from the SDA unit and recycled catalyst from one or more of the processes in the system, e.g., from one of the separation zones in the system.

In one embodiment, the recycled catalyst stream from one of the processes in the system, e.g., a separation zone, the SDA unit, etc., is combined with fresh slurry catalyst as one single catalyst feed stream. The combined catalyst feed is thereafter blended with the (treated or untreated) heavy oil feedstock stream(s) for feeding into the contacting zone(s). In another embodiment, the fresh catalyst and the recycled catalyst streams are blended into the heavy oil feedstock stream(s) as separate streams.

In one embodiment, the fresh catalyst is first preconditioned before entering one of the contacting zones, or before being brought into in contact with the heavy oil feed before entering the contacting zones. In one example, the fresh catalyst enters into a preconditioning unit along with hydrogen at a rate from 500 to 7500 SCF/BBL (BBL here refers to the total volume of heavy oil feed to the system), wherein the mixture is heated to a temperature between 400° F. to 1000° F., and under a pressure of 300 to 2500 psi in one embodiment; 500-3000 psi in a second embodiment; and 600-3200 psi in a third embodiment. In another example, the catalyst is preconditioned in hydrogen at a temperature of 500 to 725° F. It is believed that instead of bringing a cold catalyst in contact with the heavy oil feed, the preconditioning step helps with the hydrogen adsorption into the active catalyst sites, and ultimately the conversion rate.

Catalysts Employed: In one embodiment, the catalyst is a multi-metallic catalyst comprising at least a Group VIB metal and optionally, at least a Group VIII metal (as a promoter), wherein the metals may be in elemental form or in the form of a compound of the metal.

In one embodiment, the catalyst is of the formula $(M^t)_a(X^u)_b(S^v)_d(C^w)_e(H^x)_f(O^y)_g(N^z)_h$, wherein M represents at least one group VIB metal, such as Mo, W, etc. or a combination thereof; and X functions as a promoter metal, representing at least one of: a non-noble Group VIII metal such as Ni, Co; a Group VIIIB metal such as Fe; a Group VIB metal such as Cr;

a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11 (a+b). H is hydrogen with the value of f ranging from 0 to 7(a+b). O represents oxygen with the value of g ranging from 0 to 5(a+b); and N represents nitrogen with h having a value of 0 to 0.5(a+b). In one embodiment, subscript b has a value of 0, for a single metallic component catalyst, e.g., Mo only catalyst (no promoter).

In one embodiment, the catalyst is prepared from a mono-, di, or polynuclear molybdenum oxysulfide dithiocarbamate complex. In a second embodiment, the catalyst is prepared from a molybdenum oxysulfide dithiocarbamate complex.

In one embodiment, the catalyst is a $MoS_2$ catalyst, promoted with at least a group VIII metal compound. In another embodiment, the catalyst is a bulk multimetallic catalyst, wherein said bulk multimetallic catalyst comprises of at least one Group VIII non-noble metal and at least two Group VIB metals and wherein the ratio of said at least two Group VIB metals to said at least one Group VIII non-noble metal is from about 10:1 to about 1:10.

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VII metals such as Mo, Co, W, etc. such as molybdenum naphthanate, vanadium naphthanate, vanadium octoate, molybdenum hexacarbonyl, and vanadium hexacarbonyl.

In one embodiment, the catalyst feed comprises slurry catalyst having an average particle size of at least 1 micron in a hydrocarbon oil diluent. In another embodiment, the catalyst feed comprises slurry catalyst having an average particle size in the range of 1-20 microns. In a third embodiment, the slurry catalyst has an average particle size in the range of 2-10 microns. In one embodiment, the feed comprises a slurry catalyst having an average particle size ranging from colloidal (nanometer size) to about 1-2 microns. In another embodiment, the catalyst comprises catalyst molecules and/or extremely small particles that are colloidal in size (i.e., less than 100 nm, less than about 10 nm, less than about 5 nm, and less than about 1 nm). In yet another embodiment, the catalyst comprises single layer $MoS_2$ clusters of nanometer sizes, e.g., 5-10 nm on edge.

In one embodiment, a sufficient amount of fresh catalyst and used catalyst is fed to the contacting zone(s) for each contacting zone to have a slurry (solid) catalyst concentration ranging from 2 to 30 wt. %. In a second embodiment, the (solid) catalyst concentration in the reactor ranges from 3 to 20 wt. %. In a third embodiment, from 5 to 10 wt. %.

In one embodiment, the amount of fresh catalyst feed into the contacting zone(s) range from 50 to 15000 wppm of Mo (concentration in heavy oil feed). In a second embodiment, the concentration of the fresh catalyst feed ranges from 150 to 2000 wppm Mo. In a third embodiment, from 250 to 5000 wppm Mo. In a fourth embodiment, the concentration is less than 10,000 wppm Mo. The concentration of the fresh catalyst into each contacting zone may vary depending on the contacting zone employed in the system, as catalyst may become more concentrated as volatile fractions are removed from a non-volatile resid fraction, thus requiring adjustment of the catalyst concentration.

Optional Treatment System—SDA: In one embodiment of the invention, a solvent deasphalting unit (SDA) is employed before the first contacting zone to pre-treat the heavy oil feedstock. In yet another embodiment, a solvent deasphalting unit is employed as an intermediate unit located after one of the intermediate separation zones.

SDA units are typically used in refineries to extract incremental lighter hydrocarbons from a heavy hydrocarbon stream, whereby the extracted oil is typically called deasphalted oil (DAO), while leaving a residue stream behind that is more concentrated in heavy molecules and heteroatoms, typically known as SDA Tar, SDA Bottoms, etc. The SDA can be a separate unit or a unit integrated into the upgrade system.

Various solvents may be used in the SDA, ranging from propanes to hexanes, depending on the desired level of deasphalting prior to feeding the contact zone. In one embodiment, the SDA is configured to produce a deasphalted oil (DAO) for blending with the catalyst feed or feeding directly into the contacting zones instead of, or in addition to the heavy oil feed. As such, the solvent type and operating conditions can be optimized such that a high volume and acceptable quality DAO is produced and fed to the contacting zone. In this embodiment, a suitable solvent to be used includes, but not limited to hexane or similar C6+ solvent for a low volume SDA Tar and high volume DAO. This scheme would allow for the vast majority of the heavy oil feed to be upgraded in the subsequent contacting zone, while the very heaviest, bottom of the barrel bottoms that does not yield favorable incremental conversion economics due to the massive hydrogen addition requirement, to be used in some other manner.

In one embodiment, all of the heavy oil feed is pre-treated in the SDA and the DAO product is fed into the first contacting zone, or fed according to a split feed scheme with at least a portion going to a contacting zone other than the first in the series. In another embodiment, some of the heavy oil feed (depending on the source) is first pre-treated in the SDA and some of the feedstock is fed directly into the contacting zone(s) untreated. In yet another embodiment, the DAO is combined with the untreated heavy oil feedstock as one feed stream to the contacting zone(s). In another embodiment, the DAO and the untreated heavy oil feedstock are fed to the system as in separate feed conduits, with the DAO going to one or more of the contacting zones and the untreated heavy oil feed going to one or more of the same or different contacting zones.

In an embodiment wherein the SDA is employed as an intermediate unit, the non-volatile fraction containing the slurry catalyst and optionally minimum quantities of coke/asphaltenes, etc. from at least one of the separation zones is sent to the SDA for treatment. From the SDA unit, the DAO is sent to at least one of the contacting zones as a feed stream by itself, in combination with a heavy oil feedstock as a feed, or in combination with the bottom stream from one of the separation zones as a feed. The DA Bottoms containing asphaltenes are sent away to recover metal in any carry-over slurry catalyst, or for applications requiring asphaltenes, e.g., blended to fuel oil, used in asphalt, or utilized in some other applications.

In one embodiment, the quality of the DAO and DA Bottoms is varied by adjusting the solvent used and the desired recovery of DAO relative to the heavy oil feed. In an optional pretreatment unit such as the SDA, the more DAO oil that is recovered, the poorer the overall quality of the DAO, and the poorer the overall quality of the DA Bottoms. With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

Controlling Heavy Metal Deposit—Water Injection: As used herein, the front-end contacting zone (or the first contacting zone) means the $1^{st}$ reactor in a system with three or less contacting zones. In one embodiment of a system with more than three contacting zones, the first front-end contacting zone may include both first and second reactors. In another embodiment, the first contacting zone means the $1^{st}$ reactor only.

As used herein, the term "water" is used to indicate either water and/or steam.

In one embodiment to control heavy metal deposit, water is injected into the system at a rate of about 1 to 25 wt. % (relative to the heavy oil feedstock). In one embodiment, a sufficient amount of water is injected for a water concentration in the system in the range of 2 to 15 wt. %. In a third embodiment, a sufficient amount is injected for a water concentration in the range of 4 to 10 wt. %.

The water can be added to the heavy oil feedstock before or after preheating. In one embodiment, a substantial amount of water is added to the heavy oil feedstock admixture that is to be preheated, and a substantial amount of water is added directly to the front end contacting zone(s). In another embodiment, water is added to the front-end contacting zone(s) via the heavy oil feedstock only. In yet another embodiment, at least 50% of the water is added to the heavy oil feedstock mixture to be heated, and the rest of the water is added directly to the front end contacting zone(s).

In one embodiment, the water introduced into the system at the preheating stage (prior to the preheating of the heavy oil feedstock), in an amount of about 1 to about 25 wt. % of the incoming heavy oil feedstock. In one embodiment, water is added to as part of the heavy oil feed to all of the contacting zones. In another embodiment, water is added to the heavy oil feed to the first contacting zone only. In yet another embodiment, water is added to the feed to the first two contacting zones only.

In one embodiment, water is added directly into the contacting zone at multiple points along the contacting zone, in ratio of 1 to 25 wt. % of the heavy oil feedstock. In yet another embodiment, water is added directly into the first few contacting zones in the process which are the most prone to deposits of heavy metals.

In one embodiment, some of the water is added to the process in the form of dilution steam. In one embodiment, at least 30% of the water added is in the form of steam. In the embodiments where water is added as dilution steam, the steam may be added at any point in the process. For example, it may be added to the heavy oil feedstock before or after preheating, to the catalyst/heavy oil mixture stream, and/or directly into the vapor phase of the contacting zones, or at multiple points along the first contacting zone. The dilution steam stream may comprise process steam or clean steam. The steam may be heated or superheated in a furnace prior to being fed into the upgrade process.

It is believed that the presence of the water in the process favorably alter the metallic compound sulfur molecular equilibrium, thus reducing the heavy metal deposit. In one embodiment, the addition of water is also believed to help control/maintain a desired temperature profile in the contacting zones. In yet another embodiment, it is believed that the addition of water to the front end contacting zone(s) lowers the temperature of the reactor(s). As the reactor temperature is lowered, it is believed that the rate of reaction of the most reactive vanadium species slows down, allowing vanadium deposition onto the slurry catalyst to proceed in a more controlled manner and for the catalyst to carry the vanadium deposits out of the reactor thus limiting the solid deposit in the reactor equipment.

In one embodiment, the addition of water reduces the heavy metal deposits in the reactor equipment at least 25% compared to an operation without the addition of water, for a comparable period of time in operation, e.g., for at least 2 months. In another embodiment, the addition of water reduces heavy metal deposits of at least 50% compared to an operation without the water addition. In a third embodiment, the addition of water reduces heavy metal deposits of at least 75% compared to an operation without the water addition.

Controlling Heavy Metal Deposit with Reactor Temperature: In one embodiment, instead of and/or in addition to the addition of water to the front end contacting zone(s), the temperature of the front end contacting zone(s) most prone to heavy metal deposits is lowered.

In one embodiment, the temperature of the first reactor is set to be at least 10° F. (5.56° C.) lower than the next reactor in series. In a second embodiment, the first reactor temperature is set to be at least 15° F. (8.33° C.) than the next reactor in series. In a third embodiment, the temperature is set to be at least 20° F. (11.11° C.) lower. In a fourth embodiment, the temperature is set to be at least 25° F. (13.89° C.) lower than the next reactor in series.

Controlling Heavy Metal Deposit with Recycled Catalyst Stream: In one embodiment, at least a portion of the non-volatile stream from at least one of the separation zones and/or an interstage deasphalting unit is recycled back to the front end contacting zone(s) to control the heavy metal deposits.

In one embodiment, this recycled stream ranges between 3 to 50 wt. % of total heavy oil feedstock to the process. In a second embodiment, the recycled stream is in an amount ranging from 5 to 35 wt. % of the total heavy oil feedstock to the system. In a fourth embodiment, the recycled stream is at least 10 wt. % of the total heavy oil feedstock to the system. In a fifth embodiment, the recycled stream is 15 to 35 wt. % of the total heavy oil feed. In a sixth embodiment, the recycled stream is at least 35 wt. %. In a seventh embodiment, the recycled stream ranges between 40 to 50 wt. % In an eight embodiment, the recycled stream ranges between 35 to 50 wt. %.

In one embodiment, the recycled stream comprises non-volatile materials from the last separation zone in the system, containing unconverted materials, heavier hydrocracked liquid products, slurry catalyst, small amounts of coke, asphaltenes, etc. In one embodiment, the recycled stream contains between 3 to 30 wt. % slurry catalyst. In another embodiment, the catalyst amount ranges from 5 to 20 wt. % In yet another embodiment, the recycled stream contains 1 to 15 wt. % slurry catalyst.

In some embodiments, it is believed that with additional recycled catalyst provided by the recycled stream, more catalytic surface area (via the slurry catalyst in the recycled stream) is available to spread the heavy metal deposition, thus there is less trapping or deposition on the equipment. The additional catalyst surface areas provided by the recycled stream helps minimize overloading the catalyst surface with heavy metal deposit, leading to deposition on the process equipment (walls, internals, etc.).

Figures Illustrating Embodiments: Reference will be made to the figures to further illustrate embodiments of the invention. FIG. 1 is a block diagram schematically illustrating a system for upgrading heavy oil feedstock with reduced heavy metal deposits. First, a heavy oil feedstock is introduced into the first contacting zone in the system together with a slurry catalyst feed. In the figure, the slurry catalyst feed comprises a combination of fresh catalyst and recycled catalyst slurry as separate streams. Hydrogen may be introduced together with the feed in the same conduit, or optionally, as a separate feed stream. Water and/or steam may be introduced together with the feed and slurry catalyst in the same conduit or a separate feed stream. Although not shown, the mixture of water, heavy oil feed, and slurry catalyst can be preheated in a heater prior to feeding into the contacting zone. Although not shown, additional hydrocarbon oil feed, e.g., VGO, naphtha, in an amount ranging from 2 to 30 wt. % of the heavy oil feed can be optionally added as part of the feed stream to any of the contacting zones in the system.

Although not shown in the figures, the system may comprise recirculating/recycling channels and pumps for promoting the dispersion of reactants, catalyst, and heavy oil feedstock in the contacting zones, particularly with a high recirculation flow rate to the first contacting zone to induce turbulent mixing in the reactor, thus reducing heavy metal deposits. In one embodiment, a recirculating pump circulates through the loop reactor, thus maintaining a temperature difference between the reactor feed point to the exit point ranging from 1 to 50° F., and preferably between 2-25° F.

In the contacting zones under hydrocracking conditions, at least a portion of the heavy oil feedstock (higher boiling point hydrocarbons) is converted to lower boiling hydrocarbons, forming an upgraded product. The water/steam in the first contacting zone is expected to cut down on the heavy metal deposits onto the equipment. Although not illustrated, the temperature of the first contacting zone can be kept at least 5-25 degrees (Fahrenheit) lower than the temperature of the next contacting zone in series.

Upgraded material is withdrawn from the $1^{st}$ contacting zone and sent to a separation zone, e.g., a hot separator, operated at a high temperature and high pressure similar to the contacting zone. The upgraded material may be alternatively introduced into one or more additional hydroprocessing reactors (not shown) for further upgrading prior to going to the hot separator. The separation zone causes or allows the separation of gas and volatile liquids from the non-volatile fractions. The gaseous and volatile liquid fractions are withdrawn from the top of the separation zone for further processing. The non-volatile (or less volatile) fraction is withdrawn from the bottom. Slurry catalyst and entrained solids, coke, hydrocarbons newly generated in the hot separator, etc., are withdrawn from the bottom of the separator and fed to the next contacting zone in the series. In one embodiment (not shown), a portion of the non-volatile stream is recycled back to one of the contacting zones preceding the separation zone, providing recycled catalyst for use in the hydroconversion reactions.

In one embodiment (as indicated by dotted lines), portions of the fresh catalyst feed and heavy oil feedstock are fed directly into contacting zones (reactors) other than the $1^{st}$ contacting zone in the system. In one embodiment wherein portions of the heavy oil feedstock are fed directly into contacting zones other than the $1^{st}$ contacting zone, water and/or steam is also provided to the contacting zones as a separate feed stream, or introduced together with the feed and slurry catalyst in the same conduit.

The liquid stream from the preceding separation zone is combined with optional fresh catalyst, optional additional heavy oil feed, optional hydrocarbon oil feedstock such as VGO (vacuum gas oil), and optionally recycled catalyst (not shown) as the feed stream for the next contacting zone in the series. Hydrogen may be introduced together with the feed in the same conduit, or optionally, as a separate feed stream. Upgraded materials along with slurry catalyst flow to the next separation zone in series for separation of gas and volatile liquids from the non-volatile fractions. The gaseous and volatile liquid fractions are withdrawn from the top of the separation zone, and combined with the gaseous and volatile liquid fractions from a preceding separation zone for further processing. The non-volatile (or less volatile) fraction stream is withdrawn and sent to the next contacting zone in series for the unconverted heavy oil feedstock to be upgraded.

In the last contacting zone, hydrogen is added along with the unconverted heavy oil feedstock, optional additional heavy oil feedstock, optional VGO feed, and optional fresh catalyst. Upgraded materials flow to the next separation zone along with slurry catalyst, wherein the upgraded products are removed overhead, and a portion of the non-volatile materials are recycled. In one embodiment, the recycled stream is sent to the first contacting zone, providing some of recycled catalyst for use in the hydroconversion reactions. In a second embodiment, the recycled stream is split amongst the contacting zones preceding the last contacting zone in the series.

In one embodiment, the system may optionally comprise an in-line hydrotreater (not shown) for treating the gaseous and volatile liquid fractions from the separation zones. The in-line hydrotreater in one embodiment employs conventional hydrotreating catalysts, is operated at a similarly high pressure (within 10 psig) as the rest of the upgrade system, and capable of removing sulfur, Ni, V, and other impurities from the upgraded products. In another embodiment, the in-line hydrotreater operates at a temperature within 100° F. of the temperature of the contacting zones.

Figure 2:
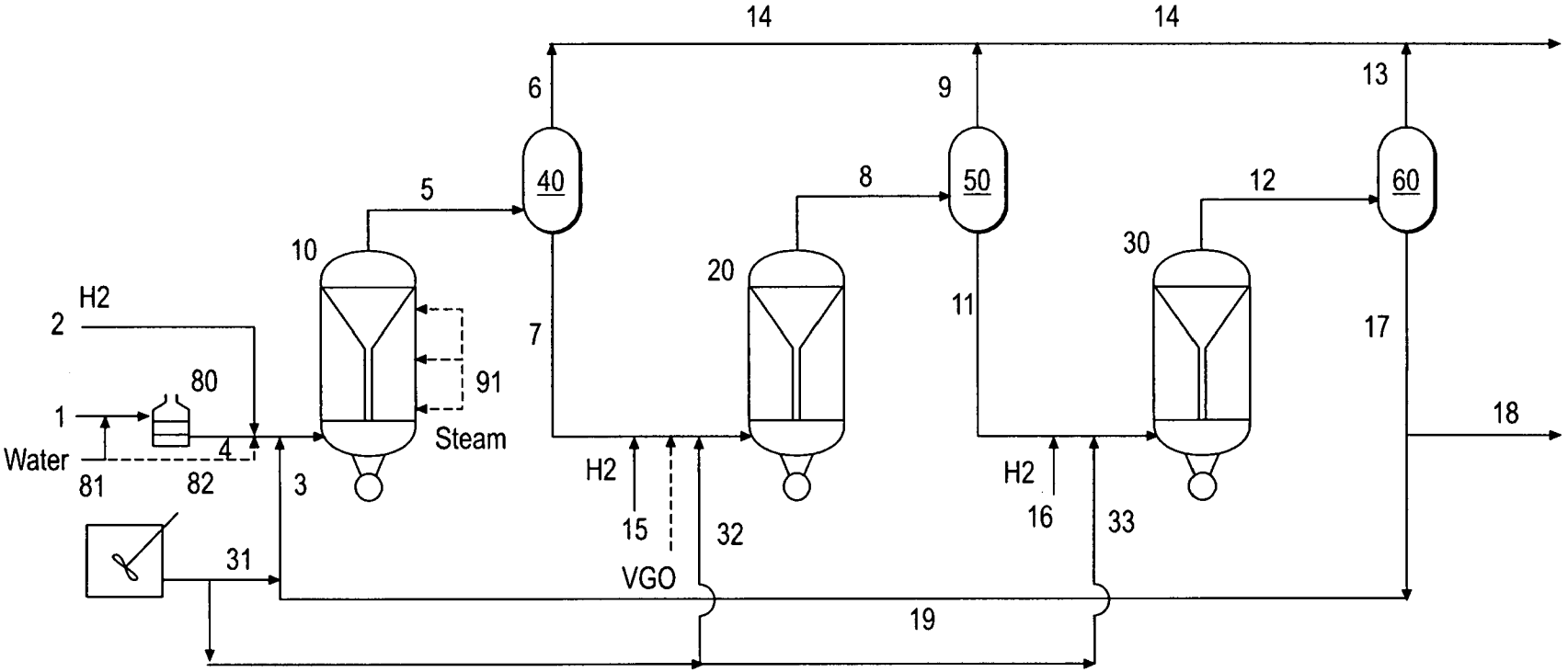
FIG. 2 is a flow diagram of a process to upgrade heavy oil feeds with water injection.

FIG. 2 is a flow diagram of a heavy oil upgrade process with water injection. As shown, water 81 is injected into the system with the heavy oil feedstock 1, with the mixture being preheated in furnace 80 before being introduced into the contacting zone. Water/steam can also be optionally injected into the system after the preheater 80 as stream 82. In this embodiment, the fresh catalyst feed is split amongst the contacting zones as 31, 32, and 33. Recycle catalyst stream 17, water/heavy oil feedstock mixture, and hydrogen gas 2 are fed to the first contacting zone as feed 3.

Stream 4 comprising upgraded heavy oil feedstock exits the contacting zone R-10 flows to a separation zone 40, wherein gases (including hydrogen) and upgraded products in the form of volatile liquids are separated from the non-volatile liquid fraction 7 and removed overhead as stream 6. The non-volatile stream 7 is sent to the next contacting zone 20 in series for further upgrade. Non-volatile stream 7 contains slurry catalyst in combination with unconverted oil, and small amounts of coke and asphaltenes in some embodiments.

The upgrade process continues with the other contacting zones as shown, wherein the feed stream to contacting zone 20 comprises non-volatile fractions, hydrogen feed, optional VGO feed, and fresh catalyst feed 32. From contacting zone 20, stream 8 comprising upgraded heavy oil feedstock flows to separation zone 50, wherein upgraded products are combined with hydrogen and removed as overhead product 9. Bottom stream 11 containing non-volatile fractions, e.g., catalyst slurry, unconverted oil containing coke and asphaltenes flow to the next contacting zone in the series 30.

In contacting zone 30, additional hydrogen containing gas 16, fresh catalyst 33, optional hydrocarbon feed such as VGO (not shown), optional untreated heavy oil feed (not shown), are added to the non-volatile stream from the preceding separation zone. From contacting zone 30, upgraded products, unconverted heavy oil, slurry catalyst, hydrogen, etc. are removed overhead as stream 12 and sent to the next separation zone 60. From the separator, overhead stream 13 containing hydrogen and upgraded products is combined with the overhead streams from preceding separation zones, and sent away for subsequent processing in another part of the system, e.g., to a high pressure separator and/or lean oil contactor and/or an in-line hydrotreater (not shown). A portion of the non-volatile stream 17 is removed as bleed-off stream 18. The rest is recycled back to at least one of the contacting zones (first contacting zone 10 as shown) as a recycled catalyst stream.

Figure 3:
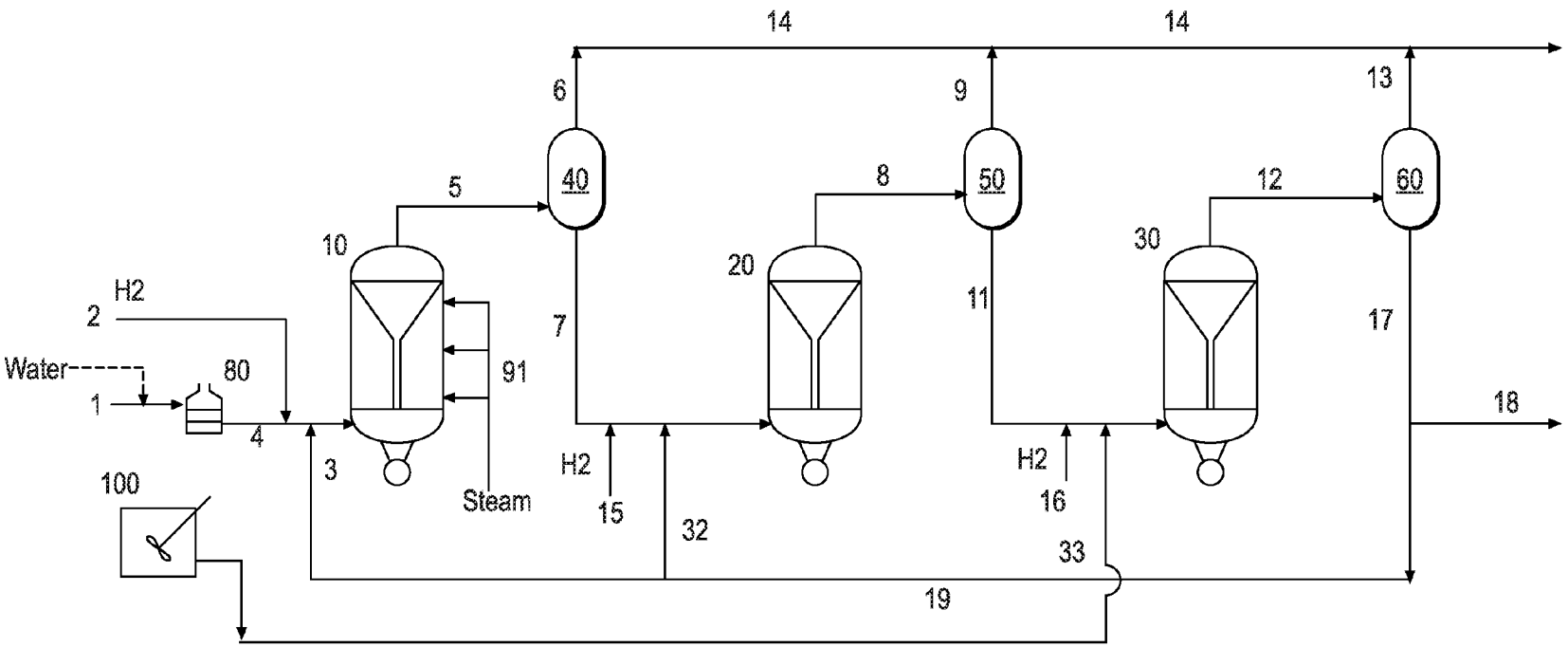
FIG. 3 is a flow diagram of a process to upgrade heavy oil feeds with steam injection directly into a front end contacting zone.

FIG. 3 is a flow diagram of another embodiment of the heavy oil upgrade process, but with steam injection 91 instead of/or in addition to the water injection stream 81.

Figure 4:
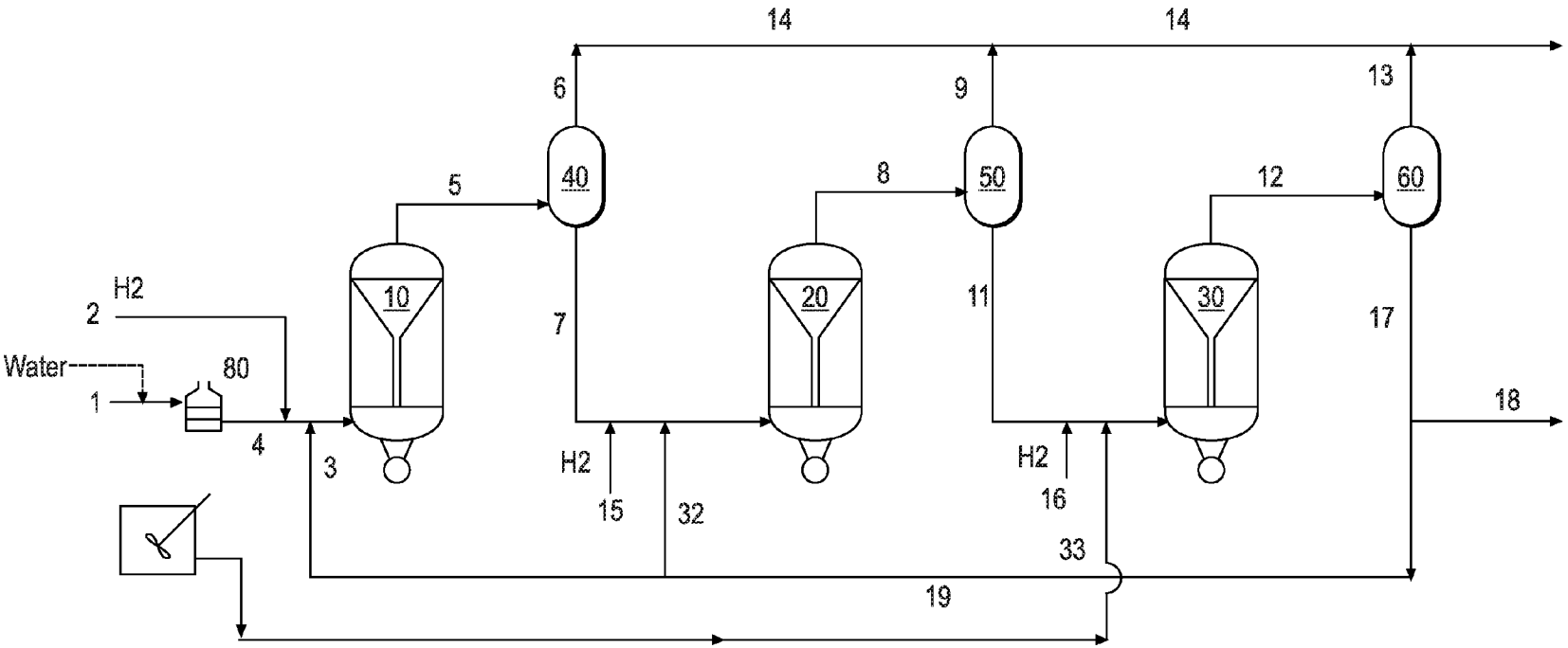
FIG. 4 is a flow diagram of another embodiment of process to upgrade heavy oil feeds with a recycled catalyst stream at a sufficient rate to reduce heavy metal build-up.

FIG. 4 is a flow diagram of another embodiment of the heavy oil upgrade process, with a recycled catalyst stream 19 ranging between 3 to 50 wt. % of total heavy oil feedstock to the process.

The following examples are given as non-limitative illustration of aspects of the present invention.

COMPARATIVE EXAMPLE 1

Heavy oil upgrade experiments were carried out in a pilot system having three gas-liquid slurry phase reactors connected in series with three hot separators, each being connected in series with the reactors. The upgrade system was run continuously for about 50 days.

A fresh slurry catalyst used was prepared according to the teaching of US Patent No. 2006/0058174, i.e., a Mo compound was first mixed with aqueous ammonia forming an aqueous Mo compound mixture, sulfided with hydrogen compound, promoted with a Ni compound, then transformed in a hydrocarbon oil (other than heavy oil feedstock) at a temperature of at least 350° F. and a pressure of at least 200 psig, forming an active slurry catalyst to send to the first reactor.

The hydroprocessing conditions were as follows: a reactor temperature (in three reactors) of about 825° F.; a total pressure in the range of 2400 to 2600 psig; a fresh Mo/fresh heavy oil feed ratio (wt. %) 0.20-0.40; fresh Mo catalyst/total Mo catalyst ratio 0.125-0.250; total feed LHSV about 0.070 to 0.15; and $H_2$ gas rate (SCF/bbl) of 7500 to 20000.

Effluent taken from each reactor was sent to the separator (connected in series), and separated into a hot vapor stream and a non-volatile stream. Vapor streams were removed from the top of the high pressure separators and collected for further analysis ("HPO" or high-pressure overhead streams). The non-volatile stream containing slurry catalyst and unconverted heavy oil feedstock was removed from the separator and sent to the next reactor in series.

A portion of the non-volatile stream from the last separator in an amount of 30 wt. % of heavy oil feedstock was recycled (STB), and the rest was removed as a bleed stream (in an amount of about 15 wt. % of the heavy oil feedstock). The STB stream contains about 10 to 15 wt. % slurry catalyst.

The feed blend to the system was high metals heavy crude with the properties specified in Table 1.

TABLE 1

| | VR feed |
|---|---|
| API gravity at 60/60 | — |
| Specific gravity | 1.0760 |
| Sulfur (wt %) | 5.27015 |

TABLE 1-continued

| | VR feed |
|---|---|
| Nitrogen (ppm) | 7750 |
| Nickel (ppm) | 135.25 |
| Vanadium (ppm) | 682.15 |
| Carbon (wt %) | 83.69 |
| Hydrogen (wt %) | 9.12 |
| H/C Ratio | 0.109 |

After 50 days of operation, the operation was shut down. The reactor, distributor and internal thermowell were visually inspected. All three pieces show significant built-up of deposit, with approximately 28.5% of the volume of the front-end ($1^{st}$) reactor being lost due to deposits of heavy metals. Analysis of the used slurry catalyst in the bleed stream over the 50 day period showed an increasing deficit in vanadium, suggesting that the deposit build up inside the front end reactor was not only happening but actually worsening over the course of the run. The performance of the process also suffered, due to the loss in the reaction volume.

Example 2

Example 1 was repeated, except that the temperature of the $1^{st}$ reactor was decreased 20° F. (from about 825° F. to about 805° F.), the recycled catalyst rate was increased from 30 wt. % (in Example 1) to about 40 wt. % of the heavy oil feed rate, and water was added to the front end reactor at a rate equivalent to 5 wt. % of the heavy oil feed rate. The system ran for 54 days before shutdown.

Water injection was carried out by adding water to the fresh catalyst, then the water catalyst mixture was added to an autoclave along with the heavy oil feed and hydrogen, with the mixture being pre-heated to a temperature of about 350° F.

Analysis of the used slurry catalyst in the bleed stream over the 54 day period showed a fairly close agreement between the amount of vanadium expected to exit the process and the amount of vanadium in the catalyst in the bleed stream, suggesting that vanadium trapping has significantly reduced, thus heavy metal deposit in the equipment.

The analytical results were further confirmed by visual inspections of the reactor internals, distributor, and internal thermowell. The equipment was significantly cleaner in Example 2, with only 6.6% of the front end reactor volume being lost due to heavy metal deposits.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the end-points and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for hydroprocessing a heavy oil feedstock, the process employing a plurality of contacting zones and separation zones, the process comprising:

combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products;

sending a mixture of the upgraded products, slurry catalyst, hydrogen containing gas, and unconverted heavy oil feedstock to a first separation zone, whereby the upgraded products are removed with the hydrogen containing gas from the first separation zone as a first overhead stream, and the slurry catalyst, heavier hydrocracked liquid products and the unconverted heavy oil feedstock are removed from the first separation zone as a first non-volatile stream, and;

sending the first non-volatile stream to a contacting zone other than the first contacting zone, which contacting zone is maintained under hydrocracking conditions with additional hydrogen containing gas to convert at least a portion of the unconverted heavy oil feedstock to lower boiling hydrocarbons, forming additional upgraded products;

sending a mixture comprising the additional upgraded products, slurry catalyst, additional hydrogen containing gas, and unconverted heavy oil feedstock to a separation zone other than the first separation zone, whereby the additional upgraded products are removed with the additional hydrogen containing gas as an overhead stream and the slurry catalyst and the unconverted heavy oil feedstock are removed as a second non-volatile stream;

wherein the contacting zones are maintained under hydrocracking conditions at a temperature of 410° C. to 600° C., and a pressure from 10 MPa to 25 MPa, and the first contacting zone is operated at a temperature of at least 10° F. lower than a next contacting zone, wherein water is added to the first contacting zone in an amount of 1 to 25 weight % on the weight of the heavy oil feedstock.

2. The process of claim 1, wherein the first contacting zone is operated at a temperature of at least 15° F. lower than a next contacting zone.

3. The process of claim 2, wherein the first contacting zone is operated at a temperature of at least 20° F. lower than a next contacting zone.

4. The process of claim 1, wherein the water is added directly to the heavy oil feedstock prior to feeding to the first contacting zone.

5. The process of claim 4, wherein the mixture of water and heavy oil feedstock is preheated at a temperature of at least 50° C. below the hypercracking temperature.

6. The process of claim 1, wherein at least a portion of the water is added to the first contacting zone as steam injection.

7. The process of claim 6, wherein the steam is injected directly to the first contacting zone.

8. The process of claim 6, wherein the steam is injected into a plurality of feed points in the first contacting zone.

9. The process of claim 1, wherein water is added directly into the contacting zone at multiple points along the first contacting zone, in an amount ranging from 1 to 20 wt. % of the heavy oil feedstock.

10. The process of claim 1, wherein the process employs three contacting zones, and at least 10% of the heavy oil feedstock to the process is for feeding the third contacting zone.

11. The process of claim 1, wherein a sufficient amount of the hydrogen containing gas feed is provided for the process to have a volume yield of at least 115% in upgraded products comprising liquefied petroleum gas, gasoline, diesel, vacuum gas oil, and jet and fuel oils.

12. The process of claim 1, wherein at least a portion of the second non-volatile stream is recycled to at least one of the contacting zones for use as a recycled slurry catalyst, and remainder of the non-volatile stream is removed from the process as a bleed-off stream in an amount sufficient for the process to have a conversion rate of at least 98%.

13. The process of claim 12, wherein the recycled stream is sent to the first contacting zone.

14. The process of claim 12, wherein the second non-volatile stream for recycling to at least one of the contacting zones ranges between 3 to 50 wt. % of the heavy oil feedstock to the process.

15. The process of claim 12, wherein the bleed-off stream contains between 3 to 20 wt. % solid, as slurry catalyst.

16. The process of claim 12, wherein the bleed-off stream is removed in an amount sufficient for the process to have a conversion rate of at least 98.5%.

17. The process of claim 12, wherein the bleed-off stream contains between 3 to 10 vol. % solid, as recycled slurry catalyst.

18. The process of claim 1, wherein the separation zones are maintained at a temperature within 90° F. of the temperature of the contacting zones, and a pressure within 10 psi of the pressure in the contacting zones.

19. The process of claim 1, wherein the slurry catalyst has an average particle size in the range of 1-20 microns.

20. The process of claim 19, wherein the slurry catalyst comprises clusters of colloidal sized particles of less than 100 nm in size, wherein the clusters have an average particle size in the range of 1-20 microns.

21. The process of claim 1, wherein the process employ a plurality of contacting zones and separation zones, at wherein at least one contacting zone and at least one separation zone are combined into one equipment as a reactor having an internal separator.

22. The process of claim 1, wherein additional hydrocarbon oil feed other than heavy oil feedstock, in an amount ranging from 2 to 30 volume % of the heavy oil feedstock, is added to any of the contacting zones.

23. The process of claim 22, wherein the additional hydrocarbon oil feed is selected from vacuum gas oil, naphtha, medium cycle oil, solvent donor, and aromatic solvents.

24. The process of claim 1, for treating a heavy oil feedstock having a TAN of at least 0.1; a viscosity of at least 10 cSt; an API gravity at most 15; at least 0.0001 grams of Ni/V/Fe; at least 0.005 grams of heteroatoms; at least 0.01 grams of residue; at least 0.04 grams C5 asphaltenes; and at least 0.002 grams of MCR.

25. The process of claim 1, further comprising a plurality of recirculating pumps for promoting dispersion of the heavy oil feedstock and the slurry catalyst in the contacting zones.

26. The process of claim 1, further comprising recycling to at least one of the contacting zones at least a portion of the non-volatile stream.

27. A process for hydroprocessing a heavy oil feedstock, the process employing a plurality of contacting zones and separation zones, the process comprising:

combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products;

sending a mixture of the upgraded products, slurry catalyst, hydrogen containing gas, and unconverted heavy oil feedstock to a first separation zone, whereby the upgraded products are removed with the hydrogen containing gas from the first separation zone as a first overhead stream, and the slurry catalyst, heavier hydrocracked liquid products and the unconverted heavy oil feedstock are removed from the first separation zone as a first non-volatile stream, and;

sending the first non-volatile stream to a contacting zone other than the first contacting zone, which contacting zone is maintained under hydrocracking conditions with additional hydrogen containing gas to convert at least a portion of the unconverted heavy oil feedstock to lower boiling hydrocarbons, forming additional upgraded products;

sending a mixture comprising the additional upgraded products, slurry catalyst, additional hydrogen containing gas, and unconverted heavy oil feedstock to a separation zone other than the first separation zone, whereby the additional upgraded products are removed with the additional hydrogen containing gas as an overhead stream and the slurry catalyst and the unconverted heavy oil feedstock are removed as a second non-volatile stream;

wherein the contacting zones are maintained under hydrocracking conditions at a temperature of 410° C. to 600° C., and a pressure from 10 MPa to 25 MPa, and the first contacting zone is operated at a temperature of at least 10° F. lower than a next contacting zone, wherein the process further comprising an in-line hydrotreater employing hydrotreating catalysts and operating at a pressure within 50 psig of the contacting zones, for removing at least 70% of sulfur, at least 90% of nitrogen, and at least 90% of heteroatoms in the upgraded products.

28. A process for hydroprocessing a heavy oil feedstock, the process employing a plurality of contacting zones and separation zones, the process comprising:

combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products;

sending a mixture of the upgraded products, slurry catalyst, hydrogen containing gas, and unconverted heavy oil feedstock to a first separation zone, whereby the upgraded products are removed with the hydrogen containing gas from the first separation zone as a first overhead stream, and the slurry catalyst, heavier hydrocracked liquid products and the unconverted heavy oil feedstock are removed from the first separation zone as a first non-volatile stream, and sending the first non-volatile stream to a contacting zone other than the first contacting zone, which contacting zone is maintained under hydrocracking conditions with additional hydrogen containing gas to convert at least a portion of the unconverted heavy oil feedstock to lower boiling hydrocarbons, forming additional upgraded products;

sending a mixture comprising the additional upgraded products, slurry catalyst, additional hydrogen containing gas, and unconverted heavy oil feedstock to a separation zone other than the first separation zone, whereby the additional upgraded products are removed with the additional hydrogen containing gas as an overhead stream and the slurry catalyst and the unconverted heavy oil feedstock are removed as a second non-volatile stream; and wherein the contacting zones are maintained under hydrocracking conditions at a temperature of 410° C. to 600° C., and a pressure from 10 MPa to 25 MPa, and the first contacting zone is operated at a temperature of at least 10° F. lower than a next contacting zone, wherein at least a portion of the heavy oil feedstock to the process is diverted to a contacting zone other than the first contacting zone, wherein the at least a portion of the diverted heavy oil feedstock, under hydrocracking conditions, is converted to lower boiling hydrocarbons.

29. The process of claim 28, wherein at least 5% of the heavy oil feedstock is for feeding a contacting zone other the first contacting zone.

30. A process for hydroprocessing a heavy oil feedstock, the process employing a plurality of contacting zones and separation zones, the process comprising:

combining a heavy oil feedstock, a hydrogen containing gas, and a slurry catalyst in a first contacting zone under hydrocracking conditions to convert at least a portion of the heavy oil feedstock to lower boiling hydrocarbons, forming upgraded products;

sending a mixture of the upgraded products, slurry catalyst, hydrogen containing gas, and unconverted heavy oil feedstock to a first separation zone, whereby the upgraded products are removed with the hydrogen containing gas from the first separation zone as a first overhead stream, and the slurry catalyst, heavier hydrocracked liquid products and the unconverted heavy oil feedstock are removed from the first separation zone as a first non-volatile stream, and;

sending the first non-volatile stream to a contacting zone other than the first contacting zone, which contacting zone is maintained under hydrocracking conditions with additional hydrogen containing gas to convert at least a portion of the unconverted heavy oil feedstock to lower boiling hydrocarbons, forming additional upgraded products;

sending a mixture comprising the additional upgraded products, slurry catalyst, additional hydrogen containing gas, and unconverted heavy oil feedstock to a separation zone other than the first separation zone, whereby the additional upgraded products are removed with the additional hydrogen containing gas as an overhead stream and the slurry catalyst and the unconverted heavy oil feedstock are removed as a second non-volatile stream; and wherein the contacting zones are maintained under hydrocracking conditions at a temperature of 410° C. to 600° C., and a pressure from 10 MPa to 25 MPa, and the first contacting zone is operated at a temperature of at least 10° F. lower than a next contacting zone and wherein the slurry catalyst feed comprises a recycled slurry catalyst and a fresh slurry catalyst, wherein at least a portion of the fresh slurry catalyst is fed into a contacting zone other than the first contacting zone.

31. The process of claim 30, wherein all of the fresh slurry catalyst is for feeding into contacting zones other than the first contacting zone.

32. A process for hydroprocessing a heavy oil feedstock, the process employing a plurality of contacting zones and separation zones, the process comprising:

combining a heavy oil feedstock, a hydrogen containing gas, a slurry catalyst, and steam in a first contacting zone under hydrocracking conditions to convert at least a portion of the heavy oil feedstock to lower boiling hydrocarbons, forming upgraded products, wherein the steam is present in an amount of 2 to 25 weight % on the weight of the heavy oil feedstock;

sending a mixture of the upgraded products, the slurry catalyst, the hydrogen containing gas, and unconverted heavy oil feedstock to a first separation zone, whereby the upgraded products are removed with the hydrogen containing gas from the first separation zone as a first overhead stream, and the slurry catalyst and the unconverted heavy oil feedstock are removed from the first separation zone as a first non-volatile stream, and;

sending the first non-volatile stream to a contacting zone other than the first contacting zone, which contacting zone is maintained under hydrocracking conditions with additional hydrogen containing gas feed to convert at least a portion of the heavy oil feedstock to lower boiling hydrocarbons, forming additional upgraded products;

sending a mixture comprising the additional upgraded products, the slurry catalyst, the additional hydrogen containing gas, and unconverted heavy oil feedstock to a separation zone other than the first separation zone, whereby the upgraded products are removed with the additional hydrogen containing gas as an overhead stream and the slurry catalyst and the unconverted heavy oil feedstock are removed as a second non-volatile stream;

recycling to at least one of the contacting zones at least a portion of the second non-volatile stream; and wherein the first contacting zone is maintained under hydrocracking conditions at a temperature of 410° C. to 600° C., and a pressure from 10 MPa to 25 MPa, and wherein the first contacting zone is operated at a temperature of at least 5 degrees (Celsius) lower than a next contacting zone.

* * * * *